United States Patent [19]

Kunimitsu et al.

[11] Patent Number: 4,838,713

[45] Date of Patent: Jun. 13, 1989

[54] THERMAL TRANSFER PRINTER HEAD POSITION HOMING MECHANISM

[75] Inventors: Michio Kunimitsu, Yawata; Hiroshi Tomita, Tsuzuki; Akio Akao; Hiroshi Kano, both of Osaka, all of Japan

[73] Assignee: Sanyo Electric Ltd., Osaka, Japan

[21] Appl. No.: 897,382

[22] Filed: Aug. 18, 1986

[30] Foreign Application Priority Data

Aug. 20, 1985 [JP] Japan ..... 60-126653[U]
Dec. 16, 1985 [JP] Japan ..... 60-193974[U]

[51] Int. Cl.[4] ..... B41J 3/20
[52] U.S. Cl. ..... 400/120; 346/76 PH
[58] Field of Search ..... 400/120, 356; 346/76 PH

[56] References Cited

U.S. PATENT DOCUMENTS

| | | | |
|---|---|---|---|
| 3,848,720 | 11/1974 | Carlsen | 400/120 |
| 4,458,253 | 7/1984 | Goff, Jr. et al. | 400/120 |
| 4,536,772 | 8/1985 | Isogai | 400/120 |
| 4,563,692 | 1/1986 | Negita et al. | 400/120 |
| 4,625,218 | 11/1986 | Watanabe | 400/120 |
| 4,657,417 | 4/1987 | Kikuchi et al. | 400/120 |
| 4,705,414 | 11/1987 | Guy et al. | 400/120 |

FOREIGN PATENT DOCUMENTS

| | | | |
|---|---|---|---|
| 58-140266 | 8/1983 | Japan | 400/236 |
| 184685 | 10/1984 | Japan | 400/120 |
| 155485 | 8/1985 | Japan | 400/120 |

*Primary Examiner*—David A. Wiecking
*Attorney, Agent, or Firm*—James D. Hall; Thomas J. Dodd; Todd A. Dawson

[57] ABSTRACT

The thermal transfer printer of the present invention is provided with a cam follower mounted on a thermal transfer head in one body and an eccentric cam, which is controlled within a semicircle so as to be positioned at either a first position for releasing it from the cam follower to press the thermal transfer head to a platen or a second position for pressing it to release the thermal transfer head from the platen, as a construction for pressing the thermal transfer head to the platen and releasing the thermal transfer head from the platen, whereby the mechanism for pressing the thermal transfer head to the platen and releasing the thermal transfer head from the platen itself can be remarkably small-sized and is simple in action due to its remarkably small working quantity, the printer can be small-sized as a whole and improved in reliability of operation as well as durability. Furthermore, the thermal transfer printer can be stably carried out the subsequent controls after initial powering, since the positional relation between the thermal transfer head and the platen is controlled so as to be initially set to the predetermined relation without delay when it is initially powered.

6 Claims, 16 Drawing Sheets

THERMAL TRANSFER PRINTER HEAD POSITION HOMING MECHANISM

BACKGROUND OF THE INVENTION

1. Field of the Invention

This invention relates to a thermal transfer printer for color printing and, in particular, to a thermal transfer printer for color printing on a recording paper by using an ink sheet having sequential segments of ink of three primary colors or four colors including black.

2. Description of the Prior Art

A thermal transfer printer used as an output printer in the computer system, word-processor, and the like is readily capable of color printing the application of ink of several different colors to the same page of the same printing medium. Thus, such a printer can be used for outputting such data as displayed by the so-called computer graphics or to produce multi-color images.

A thermal transfer printer capable of color printing as described above has been disclosed in, for example, the Japanese Patent, Laid-open No. 58-140266 (1983).

In the thermal transfer printer such as above, generally, an ink sheet having sequential segments of ink in four colors including three primary colors (yellow, magenta, and cyan) and black and a recording paper are put one upon another and carried to a contact position between a thermal transfer head and the platen so that all colors of ink are thermally transferred to the recording paper in succession. Each time that printing in one color is completed, the recording paper is reversed, then brought forward and again printed in the succeeding color on the same page as that previously printed, the repeat of such process providing multi-color printing.

However, with a thermal transfer printer of this type, it is necessary to press a thermal transfer head to a platen or release the thermal transfer head from the platen very frequently in comparison with a usual printer. In such prior art printers, the head is pressed to the platen when a recording paper is first set on the printer to carry out the initial position setting of the recording paper relative to the thermal transfer head and then a predetermined color of an ink sheet is set to a printing position or when the recording paper is carried in the backward direction after completing the printing with an ink of one color.

However, with the above described conventional example, the mechanism comprises a first lever for pressing the thermal transfer head to the platen by a biasing force of a spring and a second lever for releasing the thermal transfer head from the platen by the action of an electro-magnetic solenoid. Accordingly, with such the conventional construction, the construction itself is complicated and the size and weight of each lever and the like is large, so that it is difficult to reduce the size of the printer as a whole and the printer has problems with respect to reliability and durability.

In addition, since the positional relation between the thermal transfer head and the platen is unstable directly after the printer is switched on, various kinds of problem occur in the subsequent controls. Accordingly, it is desired to instantly control the positional relation between the thermal transfer head and the platen to the predetermined initial condition when the printer is initially powered and carry out the subsequent controls with this initial condition as a basic state for control.

This is accomplished by the provision of mechanisms for pressing the thermal transfer head to the platen and releasing the thermal transfer head from the platen with a very simple structure of reduced size and weight, being more economical to produce and of a high reliability and durability.

SUMMARY OF THE INVENTION

The present invention is intended to overcome the problem described above and it is a primary object of the present invention to provide a thermal transfer printer with a mechanism for pressing a thermal transfer head to a platen and separating the thermal transfer head from the platen which can reliably operate with a simple structure and a reduced size and which has desired duability. This is achieved by the provision of a mechanism whereby the thermal transfer head is pressed to the platen and released from the platen by the rotation of an eccentric cam.

It is another object of the present invention to provide a thermal transfer printer capable of reliably carrying out the subsequent controls by importing the control function of initially setting the positional relation between the thermal transfer head and the platen directly after being powered to the predetermined relation without delay.

The thermal transfer printer of the invention is provided with a thermal transfer head on which a series of heating elements arranged in parallel to an axial direction of a platen, supported so as to be brought into contact with said platen or released from said platen, and a biasing member for biasing said thermal transfer head to be pressed to said platen, characterized by comprising an eccentric cam rotationally controlled so as to be positioned at either a first position, at which said thermal transfer head is pressed to said platen, or a second position, at which said thermal transfer head is released from said platen; and a cam follower being mounted on and rotating together with said thermal transfer head, which is released from a cam surface to press said thermal transfer head to said platen by the biasing force of said biasing member when said eccentric cam is positioned at the first position and pressed by the cam surface to release said thermal transfer head from said platen when said eccentric cam is position at the second position.

The above and further objects and features of the invention will more fully be apparent from the following detailed description with accompanying drawings.

DESCRIPTION OF THE PREFERRED EMBODIMENT

A description of this invention will be made with reference to the drawings showing the preferred embodiment of this invention.

Figure 1:
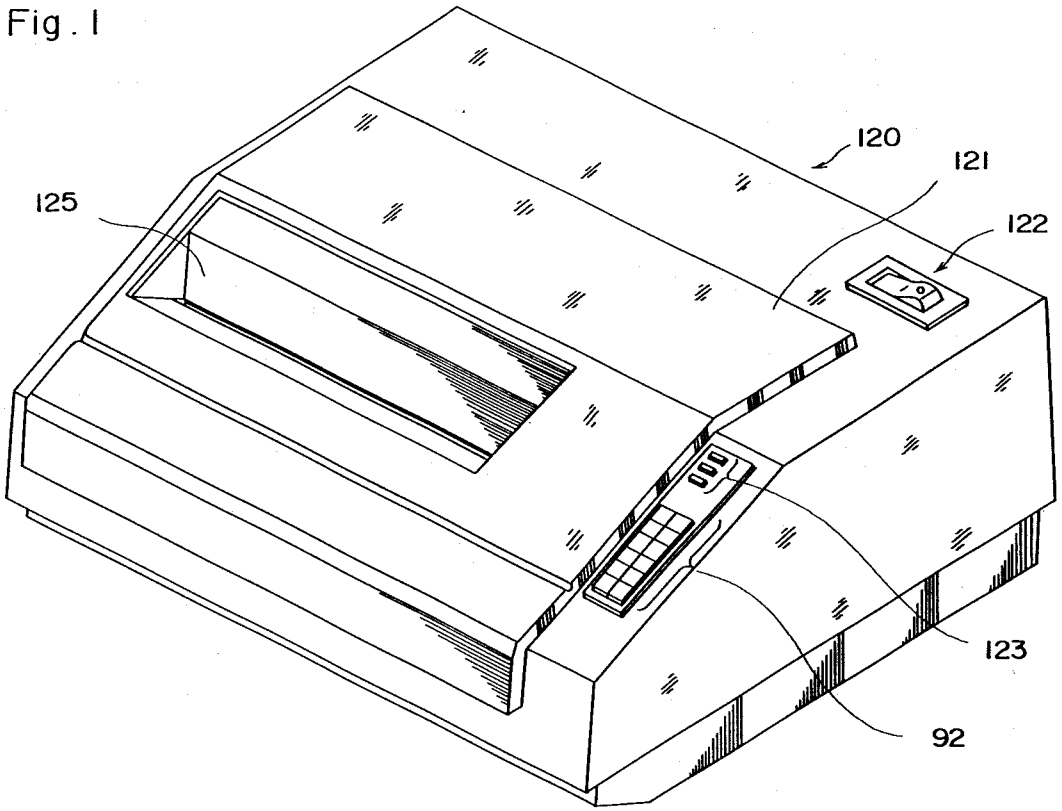
FIG. 1 is a perspective view showing the appearance of a thermal transfer printer of this invention.

FIG. 1 is a perspective view showing the appearance of a thermal transfer printer of this invention. Mechanical structural elements of the thermal transfer printer of this invention are contained in a roughly box-like casing 120. The printer is provided with a main switch 122 disposed on the upper rear end of the casing 120, an indication part 123 having various indicators, a key board 92 having various instruction keys disposed on the front right side, and a cover 121 for covering the central portions of the upper front sides throughout. An outlet 125 for the printed recording paper is provided in the upper surface of cover 121.

Figure 2:
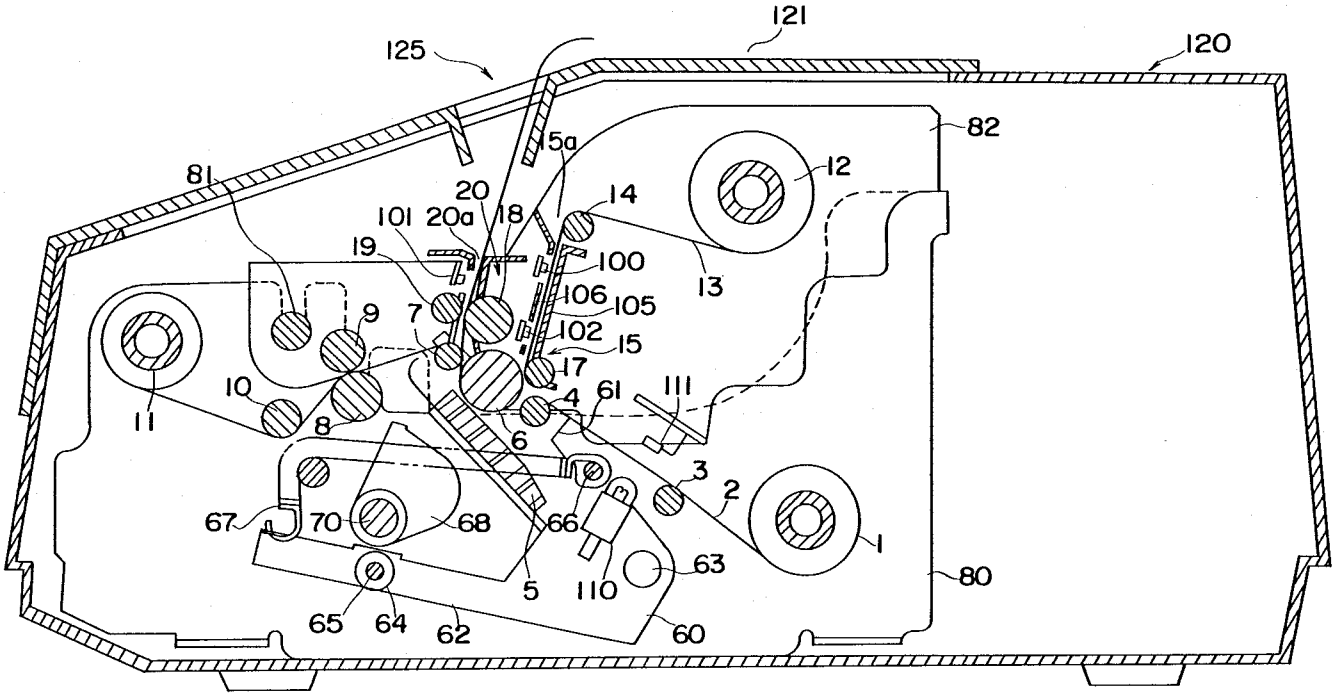
FIGS. 2 and 3 are sectional side views showing the mechanical structure thereof.
Figure 3:
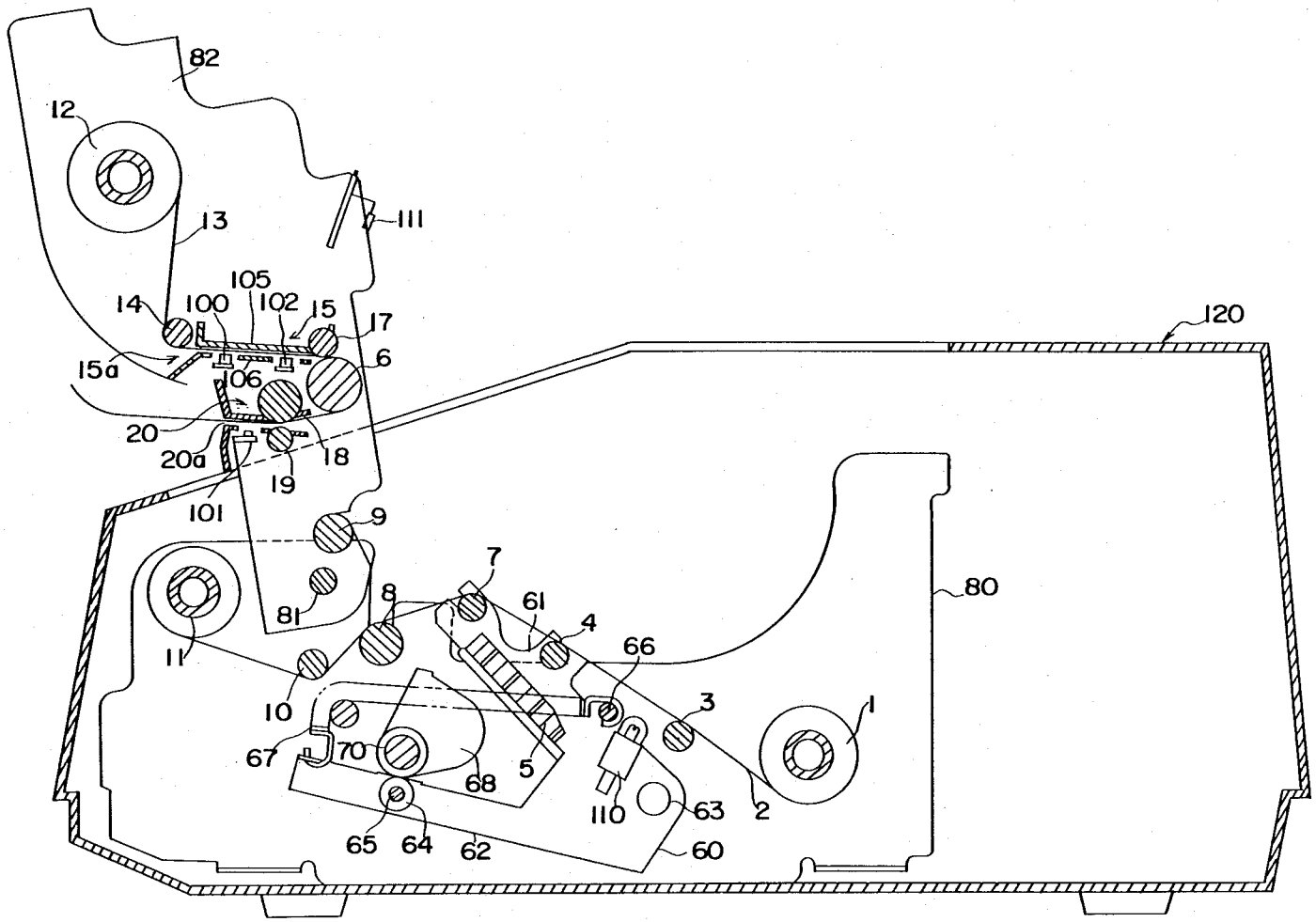

FIGS. 2 and 3 are sectional side views of a mechanical structure of the thermal transfer printer of this invention, showing a condition in which the thermal transfer head 5 and the platen 6 are pressed to each other and the other condition in which an upper part including the platen 6 is opened.

The main component members of this thermal transfer printer are fixed to a pair of stationary side plates 80 and 80 suitably fixed to the interior of the casing 120 upright on the right and left sides to be parallel with each other and also to a pair of movable side plates 82 and 82 lying above the stationary side plates 80 and 80 to be parallel with each other along the front-to-back direction (the direction of carrying the ink sheet 2 and the recording paper 13 as will be described later), being pivotally fixed to the stationary side plates 80 and 80.

Between the stationary side walls 80 and 80 and near the rear ends thereof (the right side on every drawings), is provided a supply roll 1 having the ink sheet 2 wound therearound; at the central parts of the stationary plates 80 and 80, a bracket 60 having the thermal transfer head 5 fixed thereto; at the front upper parts (the left side on every drawing), a take-up roll 11 for the ink sheet 2; in a position between the bracket 60 and the take-up roll 11, an ink sheet carrier roller 8 for carrying the ink sheet 2; and at the lower central parts of the stationary plates 80 and 80, a cam supporting shaft 70 being fixed an eccentric cam 68 whose rotational center lies on a pivot of a segment. Further provided are: a guide shaft 3 for the ink sheet 2 and a first head guide shaft 4 between the ink sheet supply roll 1 and the platen 6; a second head guide shaft 7 between the platen 6 and the ink sheet carrier roller 8; and a guide shaft 10 between the ink sheet carrier roller 8 and the take-up roll 11.

The ink sheet carrier 8 is driven by an electric driving motor 30 as will be described later (see FIGS. 4 and 5). The rotational speed of roller 8 for carrying ink sheet 2 is synchronized with the carrying speed for the recording paper 13 as will be described later.

The movable side plates 82 and 82 are pivotally supported at one end thereof at an axis 81 of rotation provided on the front upper parts of the aforesaid stationary side plates 80 and 80. This permits the platen 6 and the thermal transfer head 5 to be pressed to each other with the other ends thereof turned backward in the normal state of operation. In other words, the movable side plates 82 and 82, when put into a state of use, are provided with: a recording paper roll 12 having the recording paper 13 wound therearound, disposed near the rear ends of the side plates (near the other ends of the casing 120); a slit-like sheet-inserting passage 15 formed by guide plates 105 and 106 depending almost vertically from the guide shaft 14 in the middle portion of a space interposed between the movable side plates 82 and 82; an upwardly directed recording paper discharging passage 20 formed by the second paper carrier roller 18 and the second pressing roller 19 facing each other so that the discharge passage is roughly parallel with the recording paper inserting passage 15; a platen 6 in the form of a roller further serving as a first recording paper carrier roller disposed between the lower end parts of the inserting passage 15 and of the discharging passage 20, as well as a first pressing roller 17; and another pressing roller 9 disposed slighly behind the axis of rotation 81 lying on the front side.

A pressing position of the first pressing roller 17 against the platen 6, serving as the first carrier roller, lies on the upstream side along the carrying direction for the recording paper above a contact position produced when the thermal transfer head 5 is pressed to the platen 6 (also a position of a line of heating elements of the thermal transfer head 5). Therefore, an acting position of carrying force exerted by the platen 6 as the first recording paper carrier roller upon the recording paper lies on the upstream side along the carrying direction for the recording paper 13 above the pressing position of the thermal transfer head 5 to the platen 6.

The upper end of the inserting passage 15 and that of the discharging passage 20 lead to an inlet opening **15*a* for the recording paper 13 undergoing change of running direction thereof at the guide shaft 14 and to an outlet 20*a* for discharging the recording paper 13 toward a discharging opening 125 of the cover 121 of the casing 120**, repectively.

A positional relation between parts to be arranged when the printer is in use (a state as shown in FIG. 2) is fixed so that the pressing roller 9 and the ink sheet carrier roller 8 on the side of the stationary side plates 80 and 80 are pressed to each other at the same time that the platen 6, as the first recording paper carrier roller, and the thermal transfer head 5 are pressed to each other.

A first sensor 100 is provided in a position relatively near the upper end (near insertion opening **15*a*) of the inserting passage 15; a third sensor 102, in a relatively lower position (near the platen 6) between the first sensor and the platen 6 in the insertion passage 15, and a second sensor 101, in a position relatively near the upper part (near discharging outlet 20***a*) of the discharging passage 20. The first and the second sensors 100 and 101 are photosensors for detecting whether the recording paper is present or not, and the third sensor 102 is a photosensor for detecting a mark indicating a printing start position impressed on the recording paper 13.

The printing start position mark is used as a basis for setting a position from which printing with each color of the ink sheet 2 on the recording paper 13 is started.

A color sensor 111 is fixed to the movable side plates 82 and 82 at a position to intermediate platen 6 and ink sheet supply roll 1. Further, a light source 110 for the color sensor 111 is fixed at the position of the plate brackets 60 and 60 opposite the color sensor 111 and interposed by the carrying passage for the ink sheet 2.

When the movable side plates 82 and 82 are turned counterclockwise around shaft 81 with the cover 121 removed as shown in FIG. 3 to be put into an open state, the ink sheet supply roll 1 and the ink sheet 2 are exposed to a wide open space above the casing 120 and the ink sheet supply roll 1 is readily inserted or replaced.

When the movable side plates 82 and 82 are turned as described above, the platen 6 is displaced from its position adjacent the thermal transfer head 5. However, clockwise rotation of the thermal transfer head 5 by the spring 67 around shaft 63 is prevented by the contact of lower branch parts 62 and 62 of the plate brackets 60 and 60 with cam supporting shaft 70. Accordingly, there is no possibility that the thermal transfer head 5 may obstruct the movenent of side plates 82 and 82.

Figure 4:
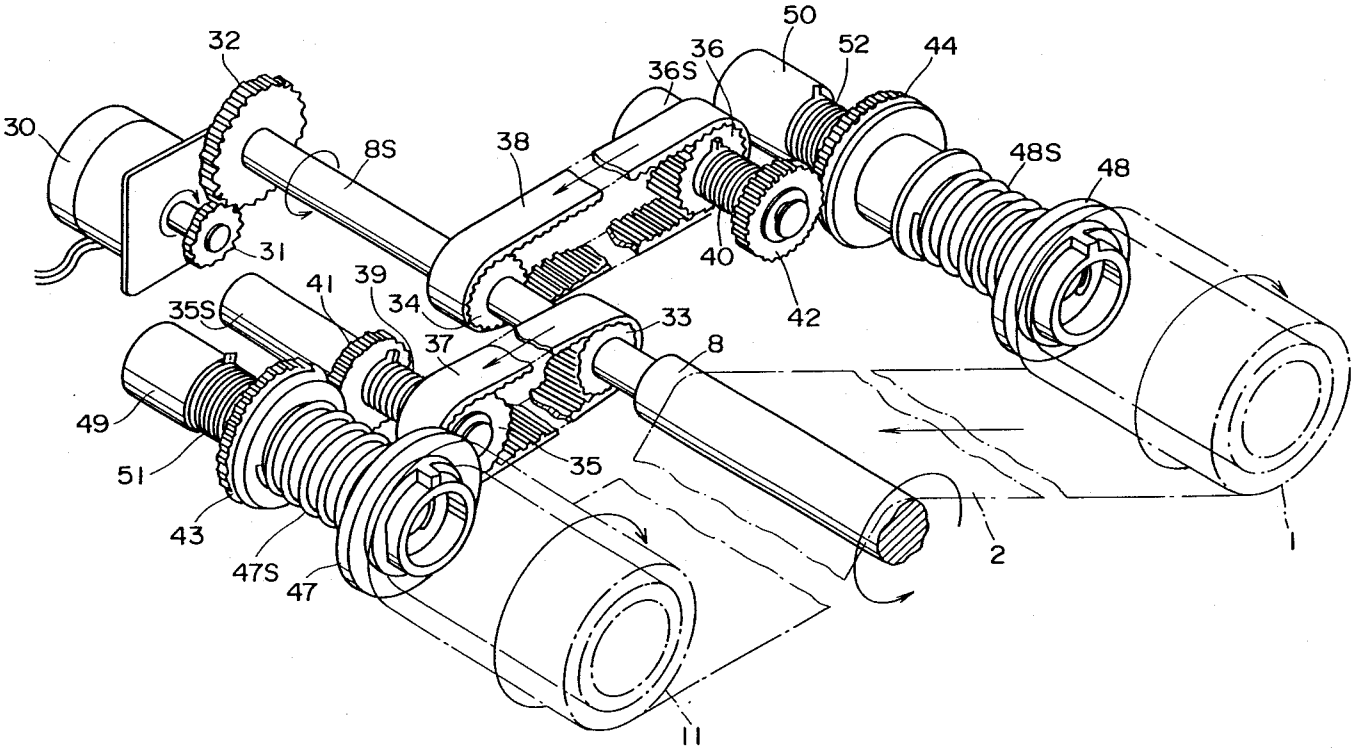
FIG. 4 is a fragmentary perspective of a structure of carrying system for the ink sheet.
Figure 5:
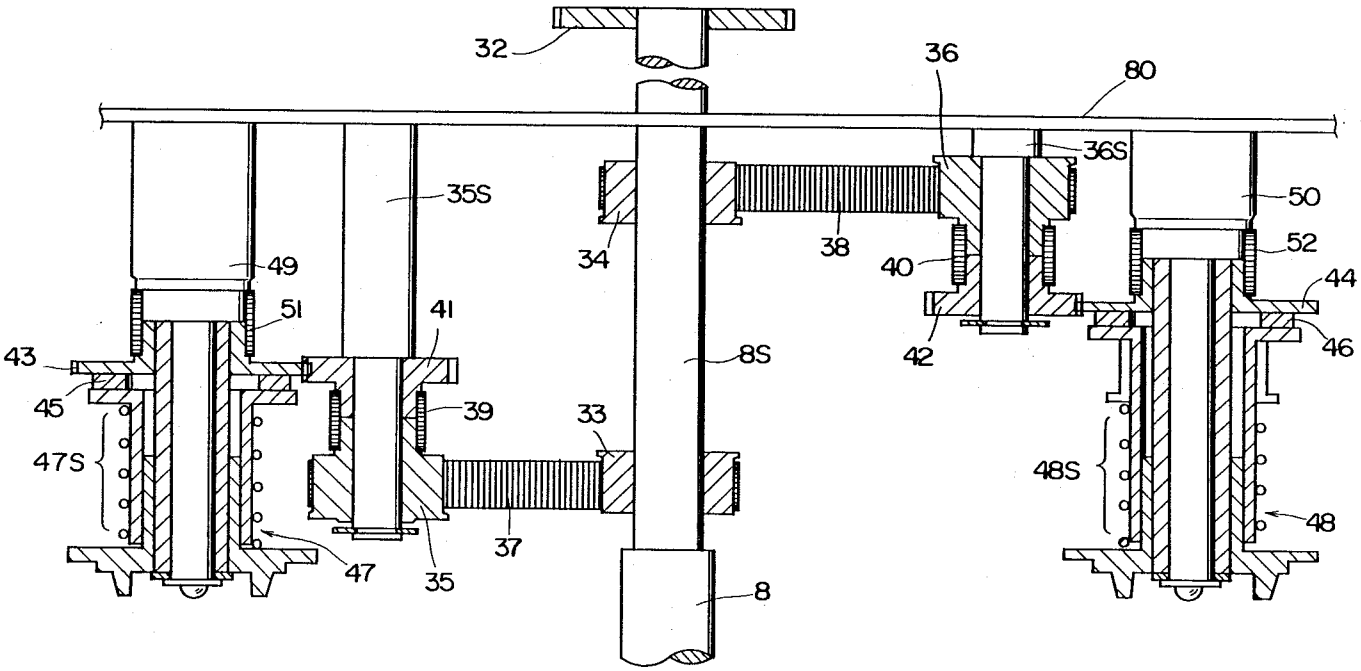
FIG. 5 is an plan view thereof.

FIGS. 4 and 5 are a fragmentary perspective view and a plan view, respectively, of a main parts composing a carrying system for the ink sheet 2.

The electric driving motor 30 used in this printer is a pulse motor capable of rotating in either direction and mounted with a spur gear 31 at the output shaft. The spur gear 31 meshes with another spur gear 32 fixed to a shaft 8S pivoted by the stationary side plates 80 and 80. The shaft 8S in mounted with spur gears 34 and 33 disposed in succession from a position near the spur gear 32 and a part thereof closer to the front end is formed of a larger diameter to work as an ink sheet carrier roller 8.

A cogged belt 37 having teeth corrugated on its inner periphery is extended between the spur gear 33 and an idler gear 35 idly mounted on a shaft 35S fixed to the side plate 80 and spaced from the shaft 8S at an appropriate distance. Another similar cogged belt 38 is extended between the spur gear 34 and an idler gear 36 idly mounted on a shaft 36S fixed to the side plate 80 and spaced from the shaft 8S at an appropriate distance. The idler gear 35 is connected to an idler gear 41 idly mounted on the shaft common thereto through a spring clutch 39. Another idler gear 36 is connected to an idler gear 42 idly mounted on the shaft common thereto through a spring clutch 40.

The spring clutch 39 transmits rotation of the idler gear 35 to the idler gear 41 only when the idler gear 35 turns counterclockwise on FIG. 4. The spring clutch 40 transmits rotation of the idler gear 36 to the idler gear 42 only when the idler gear 36 turns clockwise on FIG. 4.

The idler gears 41 and 42 mesh with idler gears 43 and 44 idly fitted onto shafts 49 and 50 fixed to stationary side plates 80 and spaced at appropriate distances from shafts 35S and 36S, respectively.

The idler gears 43 and 44 are provided with spring clutches 51 and 52 on the root sides of shafts 49 and 50, respectively. The spring clutch 51 operates for intercepting rotation of the idler gear 43 in the counterclockwise direction on FIG. 4 whereas another spring clutch 52 operates intercepting rotation of the idler gear 44 in the clockwise direction.

Friction rings 45 and 46 as well as holding reels 47 and 48 for the ink sheet take-up roll 11 and for the ink sheet supply roll 1, respectively, are idly fitted on the front end sides of the idler gears 43 and 44 on the end parts of the shafts 49 and 50, respectively. Both reels 47 and 48 press the friction rings 45 and 46 toward the idler gears 43 and 44 by means of coiled springs 47S and 48S provided for both reels, respectively.

Performance of the driving system thus constructed for the carrying of the ink sheet 2 is fully described in our co-pending Application Ser. No. 897,193, and will not be described here.

Figure 6:
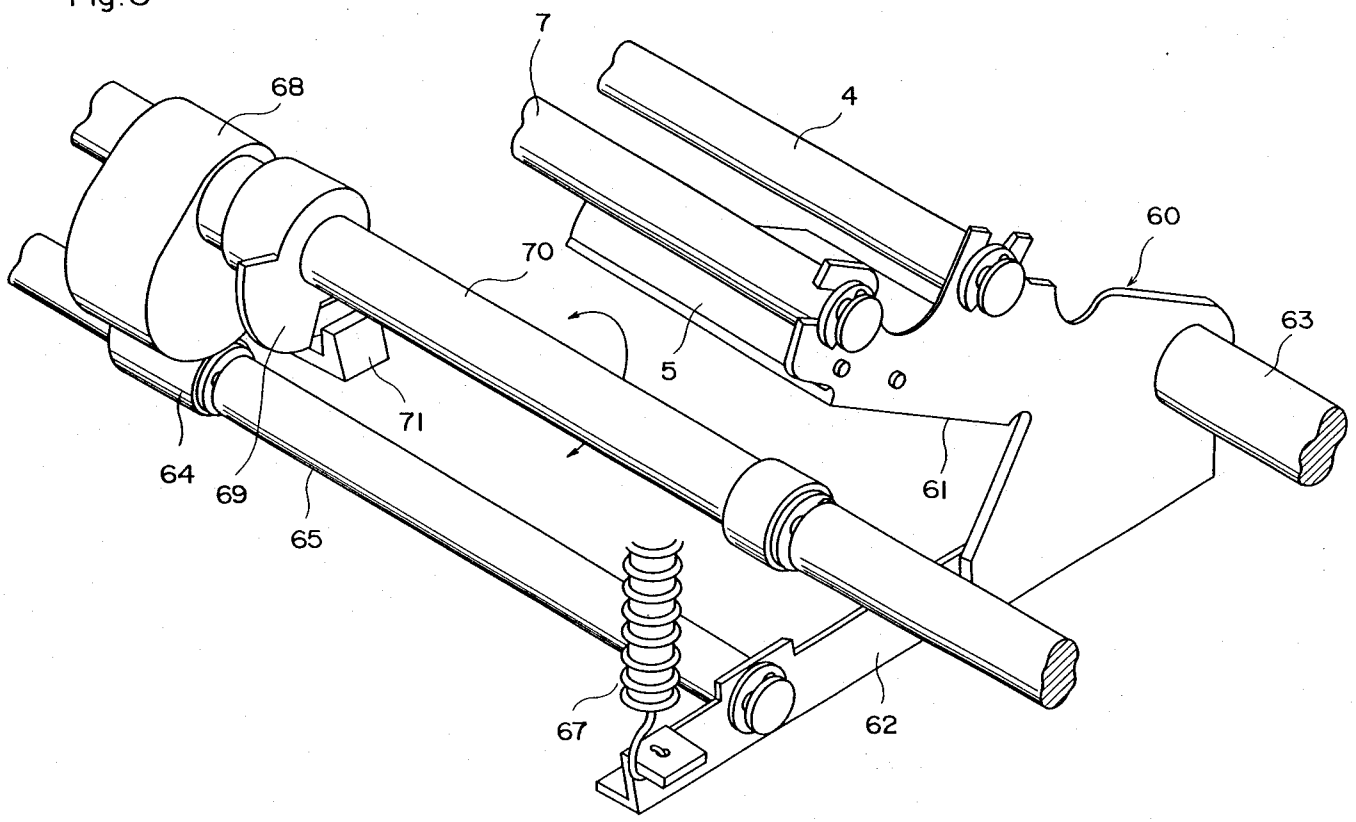
FIG. 6 is a fragmentary perspective view of a structure of a thermal transfer head and nearby parts, the major part being an eccentric cam for pressing and releasing the thermal transfer head to and from the platen.
Figure 7:
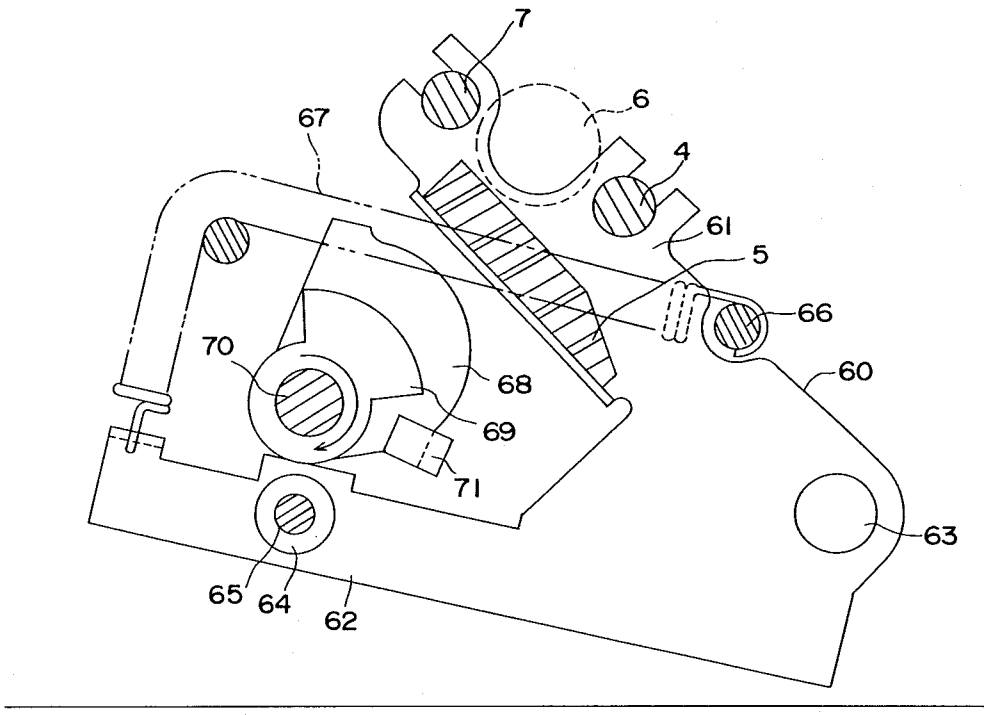
FIGS. 7 and 8 are side views thereof.
Figure 8:
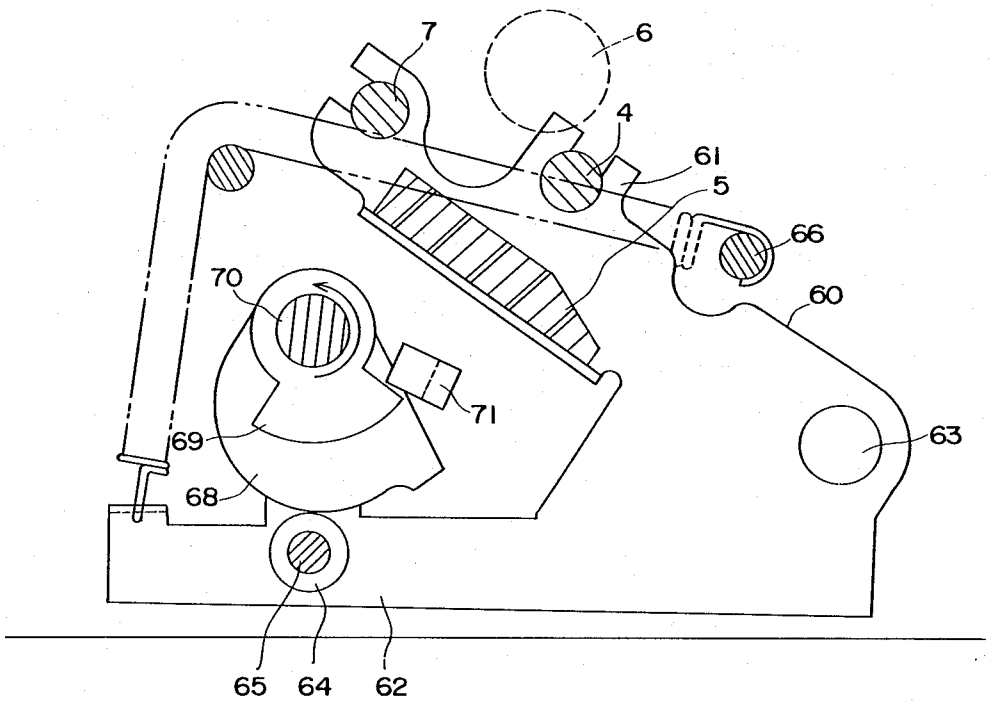

The structure around thermal transfer head 5 of the printer of this invention, particularly, a structure for adapting the printing head 5 to be pressed or to be released from the platen 6 will be described with reference to FIGS. 6, 7 and 8. FIG. 6 is a fragmentary perspective view of the structure around the thermal transfer head 5; FIG. 7 is a side view showing a state in which the platen 6 and the thermal transfer head 5 are tightly pressed together with an eccentric cam 68 set in a first position; and FIG. 8 is a side view showing a state in which th platen 6 is released from the thermal transfer head 5 with the eccentric cam 68 set in a second position.

A pair of plate brackets 60 and 60 disposed right and left for supporting the thermal transfer head 5 are each formed of an upper branch part 61 positioned above and a lower branch part 62 positioned below which extend so to be distant from each other at the front end and to provide a V-shape. Both plate brackets 60 and 60 are pivoted rotatably about a shaft 63 positioned near the stationary side plates 80 and 80 so as to be parallel with each other between the side plates 80 and 80. Further, both plate brackets 60 and 60 are made in one body with each other in order that the thermal transfer head 5, first head guide shaft 4, and second head guide shaft 7 are fixed to both upper branch parts 61 and 61 and a cam pressing shaft 65 provided with a cam pressing roller 64 as a cam follower is fixed to the lower branch parts 62 and 62.

Both plate brackets 60 and 60 are biased rearwardly upwardly (clockwise on the drawings) at the front end portion thereof to turn around the shaft 63 by tensions of the springs 67 and 67 as biasing members stretched between the front end of each of lower branch parts 62 and 62 and a shaft 66 fixed to both stationary side plates 80 and 80.

Positions of parts fixed between the plate brackets 60 and 60 are set in such manner that, when the platen 6 and the thermal transfer head 5 are pressed to each other, the first and the second head guide shafts 4, 7 are disposed before and behind the platen 6, respectively.

The position of pressing roller 64 on the cam pressing shaft 65 is set to face the cam surface of the eccentric cam 68 fixed to the aforesaid cam supporting shaft 70.

A sensor shutter 69 is also fixed to cam supporting shaft 70. A cam position sensor 71, which comprises a photo-interrupter being turning on and off by rotational position of the sensor shutter 69 when the eccentric cam 68 and the sensor shutter 69 rotate together with the rotation of the cam supporting shaft 70, is disposed on the sides of the stationary side plates 80 and 80. The cam position sensor 71 outputs: a signal "0" when the sensor shutter 69 is out of engagement with this sensor 71 on account of a positional relation that the eccentric cam 68 is in a second position where the cam surface thereof is directed downward to press the cam pressing roller 64 downward, that is, in the direction opposite to that of biasing force of the spring 67 (the thermal transfer head 5 is released from the platen 6) and is at a first position where the plate brackets 60 and 60 are urged upwardly by the springs 67 and 67 (the thermal transfer head 5 is in pressing to the platen 6) while the eccentric cam 68 is adapted to be out of contact with cam pressing roller 64 with the cam surface of the eccentric cam 68 turned upwardly; and a signal "1" when the sensor shutter 69 is in engagement with the cam position sensor 71 due to other positional relations than the above-described one.

Accordingly, as shown in, for example, FIG. 7, when a positional relation that the eccentric cam 68 is at the first position and the platen 6 is pressed to the thermal transfer head 5 is changed to a position where the cam surface of the eccentric cam 68 is brought into contact with the cam pressing roller 64 being turned on the cam supporting shaft 70 and the eccentric cam 68 reaches the second position with the cam pressing shaft 65 depressed lower, the plate brackets 60 and 60 are turned downward together at the front ends thereof in opposition to stretching force of the spring 67. Thus, as shown in FIG. 8, the thermal ransfer head 5 is released from the platen 6.

The plate brackets 60 and 60 are also provided with a light source 110 for the color sensor 111 for sensing the colors of ink of the ink sheet 2.

Figure 9:
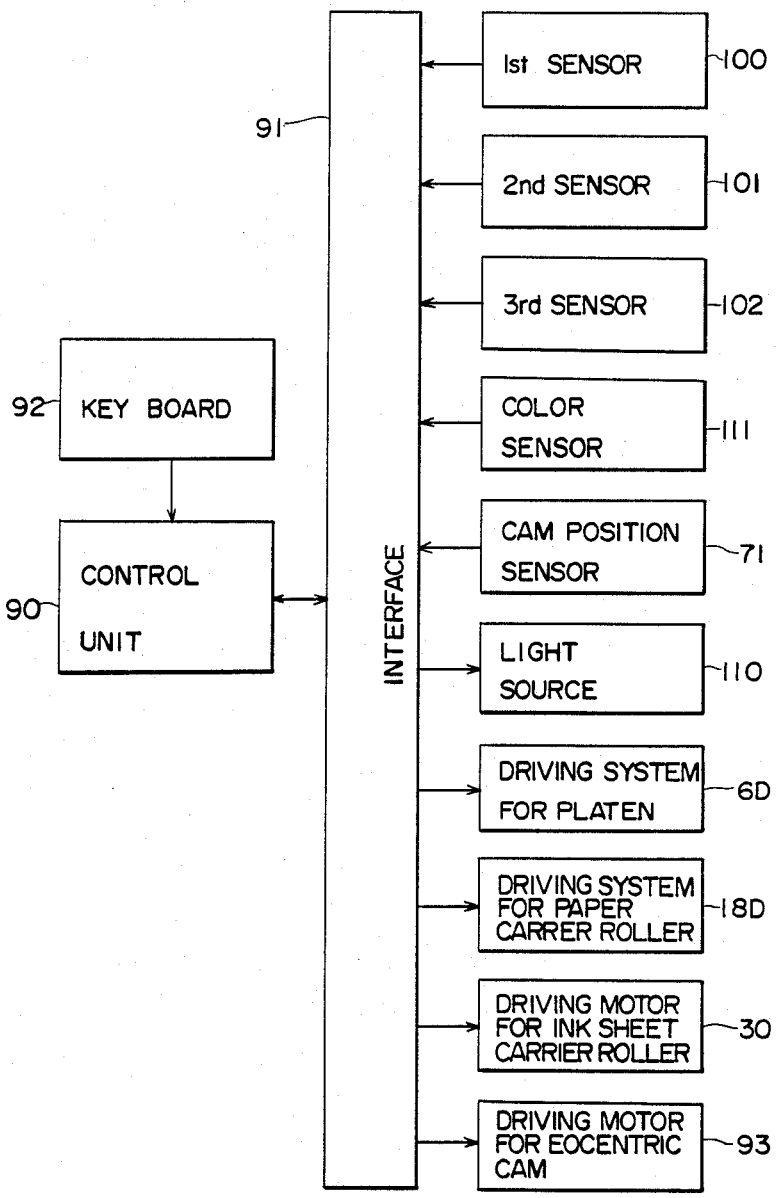
FIG. 9 is a block diagram showing a structure of a control system of the thermal transfer printer of this invention.

FIG. 9 is a block diagram showing structure of a control circuit of the thermal transfer printer of this invention.

In the drawing, the reference numeral 90 designates a microcomputer system as a control unit including CPU as a control center, ROM containing programs for various kinds of control and RAM for memorizing various kinds of information. The control unit 90 receives various kinds of key signals from the key board 92. Further, the control unit 90, while receiving signals from the aforesaid first sensor 100, second sensor 101, third sensor 102, color sensor 111, and cam position sensor 71, provides control signals to a light source 110 for the color sensor 111, driving system 6D for the platen 6 as the first recording paper carrier roller, driving system 18D for the second recording paper carrier roller 18, driving motor 30 for the ink sheet driving system, and driving motor 93 for driving the eccentric cam through an interface 91.

Next, control operation conducted by the control unit 90, that is, a performance of the thermal transfer printer of this invention will be described.

Figure 10:
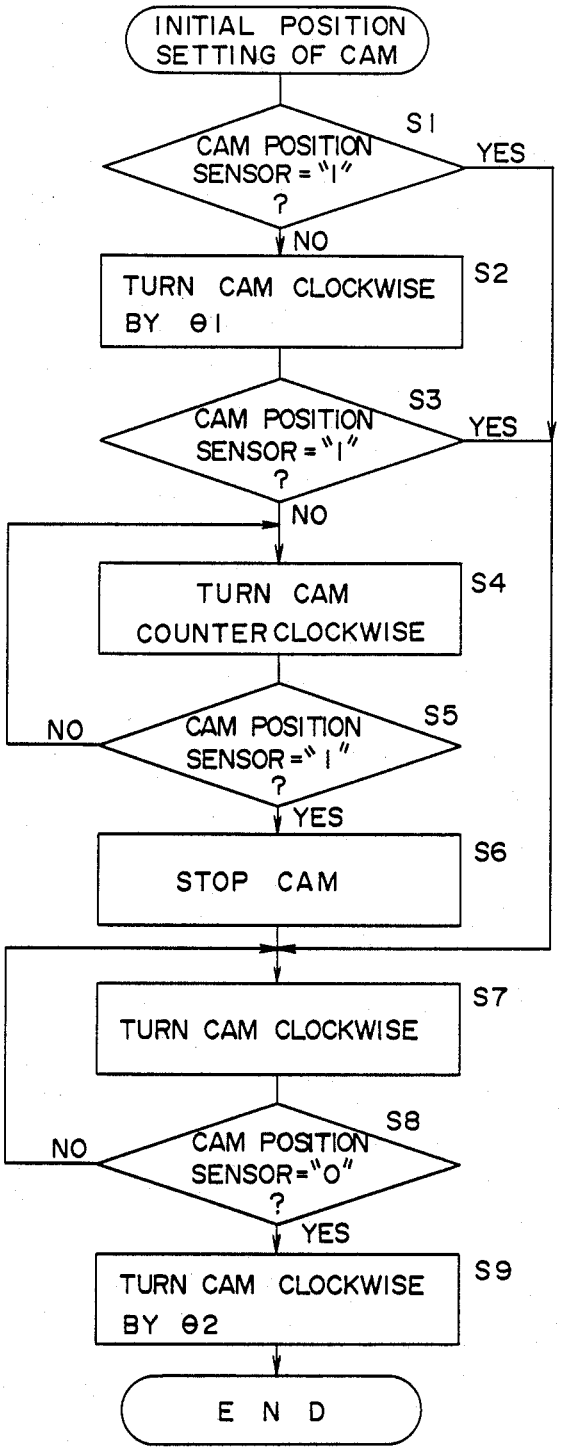
FIG. 10 is a flow chart showing the sequence for initialization of positioning of cam by a control unit.

In the thermal transfer printer of this invention, the eccentric cam 68 is initially set in the second position where the cam surface thereof presses the cam pressing roller 64 immediately after the power source is thrown in. In other words, in the printer of this invention, immediately after the power source is turned on, the platen 6 and the thermal transfer head 5 are always set in positions so as to be distant from each other. The sequence for initial position setting of the eccentric cam 68 by means of the control unit 90 will be described with reference to the flow chart in FIG. 10 and illustrative drawings in FIG. 11

First, with the power source turned on, the control unit 90 distinguishes signals outputted from the cam position sensor 71 (step S1). As a result, if the output from the cam position sensor 71 is "1", it informs that the cam surface of the eccentric cam 68 lies between the first and the second positions as shown by the black round mark (●) 68S in FIG. 11. In this case, the control unit 90 performs control to drive the eccentric cam driving motor 93 so as to move the cam surface of the eccentric cam 68 toward the second position (lower in the clockwise direction on the drawings) (step S7). When output from the cam position sensor 71 changes into "0" from "1", the control unit 90 moves the cam surface of the eccentric cam 68 from the previous position further toward the second position by a predetermined degree $\theta 2$ of angle (for example 30°) (steps S8 and S9). In this way, the eccentric cam 68 is set in the second position.

Figure 11A:
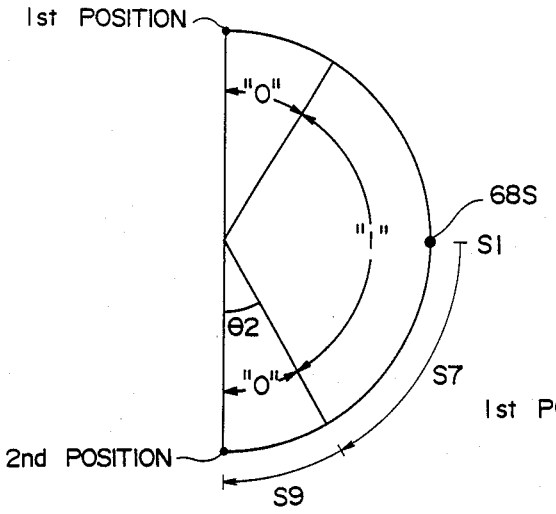
FIGS. 11*a–c* is a model view showing a position of cam for explanation of the above sequence.
Figure 11B:
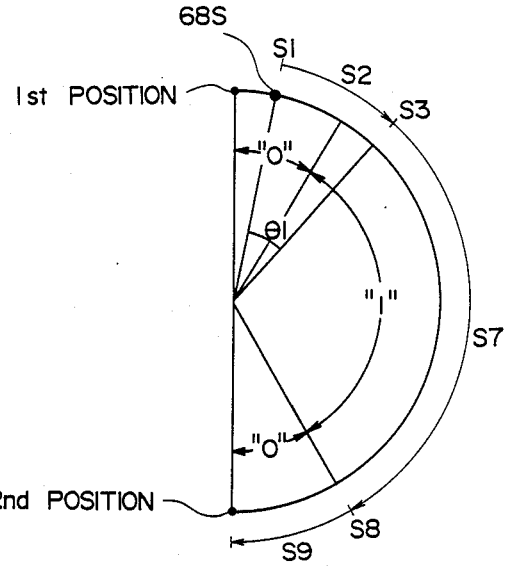
Figure 11C:
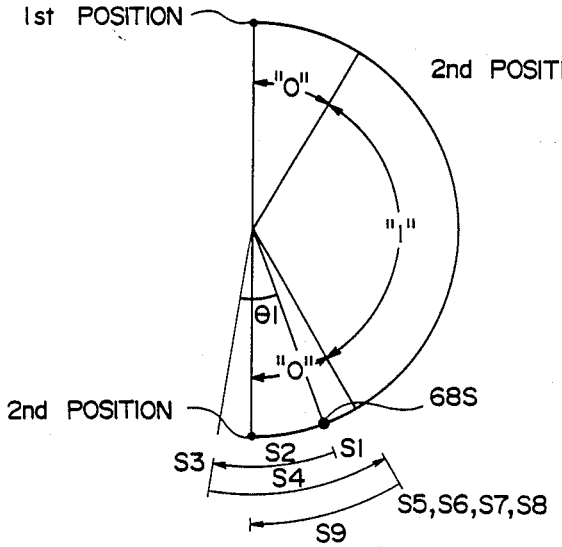

On the other hand, in the case when the output of the cam position sensor 71 is "0" when the power source is thrown in, it represents that the cam surface of the eccentric cam 68 is in or near the first position (FIG. 11(*b*)), or in or near the second position (FIG. 11(*c*)).

As shown by the round black mark 68S in FIG. 11(*b*), when the cam surface of the eccentric cam 68 is in or near the first position, the control unit 90 first performs control operation to drive the eccentric cam driving motor 93 so that the cam surface of the eccentric cam 68 may be turned clockwise on the drawings by a predetermined degree $\theta 1$ of angle (for example, 20°) (step S2). When output of the cam position sensor 71 turns into "1", the control unit 90 performs the steps S3 to aforesaid steps S7, S8, and S9 for setting a second position of the eccentric cam 68.

When the cam surface of the eccentric cam 68 is in or near the second position as shown by the black round mark 68S in FIG. 11(*c*), the control unit 90 performs the step S2 in the same way as above. In this case, however, since the eccentric cam 68 further turns clockwise from the second position, output of the cam position sensor 71 is not "1". Accordingly, the control unit 90 proceeds from the step S3 to that S4 so as to turn the eccentric cam 68 in the direction opposite to the previous one (counterclockwise on the drawings). As a result, when output of the cam position sensor 71 changes into "1", the control unit 90 distinguishes "1" from the other through the step S5 and stops the rotation of the eccentric cam 68, that is, stops driving the eccentric cam driving motor 93 (step S6). Afterward, with the successive operation of the steps S7, S8, and S9 in the same manner as before by means of the control unit 90, the eccentric cam 68 is set in the second position.

The control unit 90 always keeps the position of the eccentric cam 68 as above in the memory of RAM after initial setting of the position of the eccentric cam 68.

Figure 12:
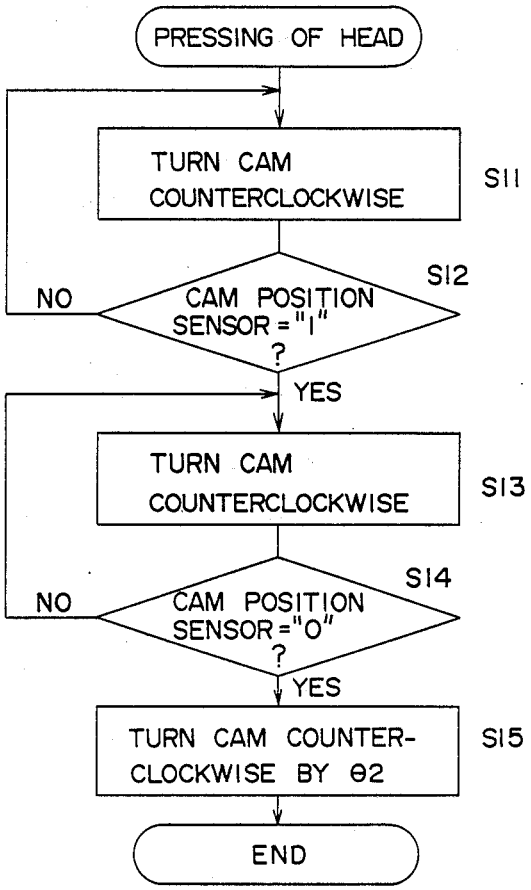
FIG. 12 is a flow chart showing the control sequence in pressing the thermal transfer head of the platen by means of the control unit.

In the thermal transfer printer of this invention, initial setting is performed in a state that the platen 6 is released from the thermal transfer head 5 immediately after the power source is switched on and, in connection therewith, a control process for pressing the thermal transfer head 5 to the platen 6 after the initial setting will be described with reference to FIG. 12 which is a flow chart showing the process performed by the control unit 90.

The control unit 90 turns the eccentric cam 68 counterclockwise until output of the cam position sensor 71 becomes "1" (steps S11 and S12). When output of the cam position sensor 71 changes into "1", the control unit 90 further turns the eccentric cam 68 counterclockwise until output of the cam position sensor 71 changes into "0" (steps S13 and S14). Upon change of output of the cam position sensor 71 into "0", the control unit 90 further turns the eccentric cam 68 by a predetermined degree $\theta 2$ of angle (30°, the same as before) counterclockwise (step S15). Through the successive processes as above, the eccentric cam 68 is turned from the second position to the first position to be set, whereby the thermal transfer head 5 is pressed to the platen 6 by biasing force of the spring 67.

Figure 13:
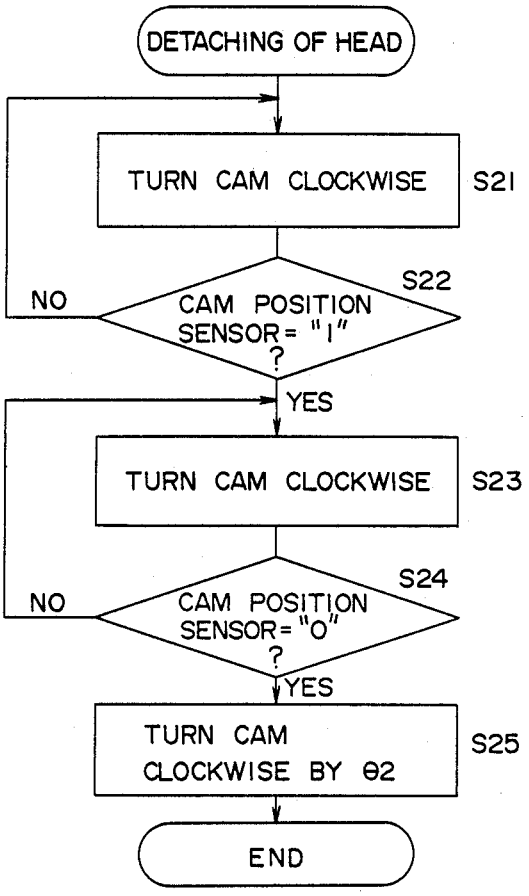
FIG. 13 is a flow chart showing the control sequence in releasing the thermal transfer head from the platen by means of the control unit.

On the other hand, the control for setting the eccentric cam 68 from the first position into the second position, is performed as shown in FIG. 13.

The control unit 90 turns the eccentric cam 68 clockwise until output of the cam position sensor 71 changes "1" (steps S21 and S22). With change of output of the cam position sensor 71 into "1", the control unit 90 further turns the eccentric cam 68 clockwise until output of the position sensor 71 changes "0" (steps S23 and S24). With change of output of the cam position sensor 71 into "0", the control unit 90 further turns the eccentric cam 68 clockwise by a predetermined degree $\theta 2$ of angle (30°, the same as before). Through the above process, the position of the eccentric cam 68 is shifted from the first one to the second one to be set so as to release the thermal transfer head 5 from the platen 6 in opposition to biasing force of the spring 67.

Figure 14:
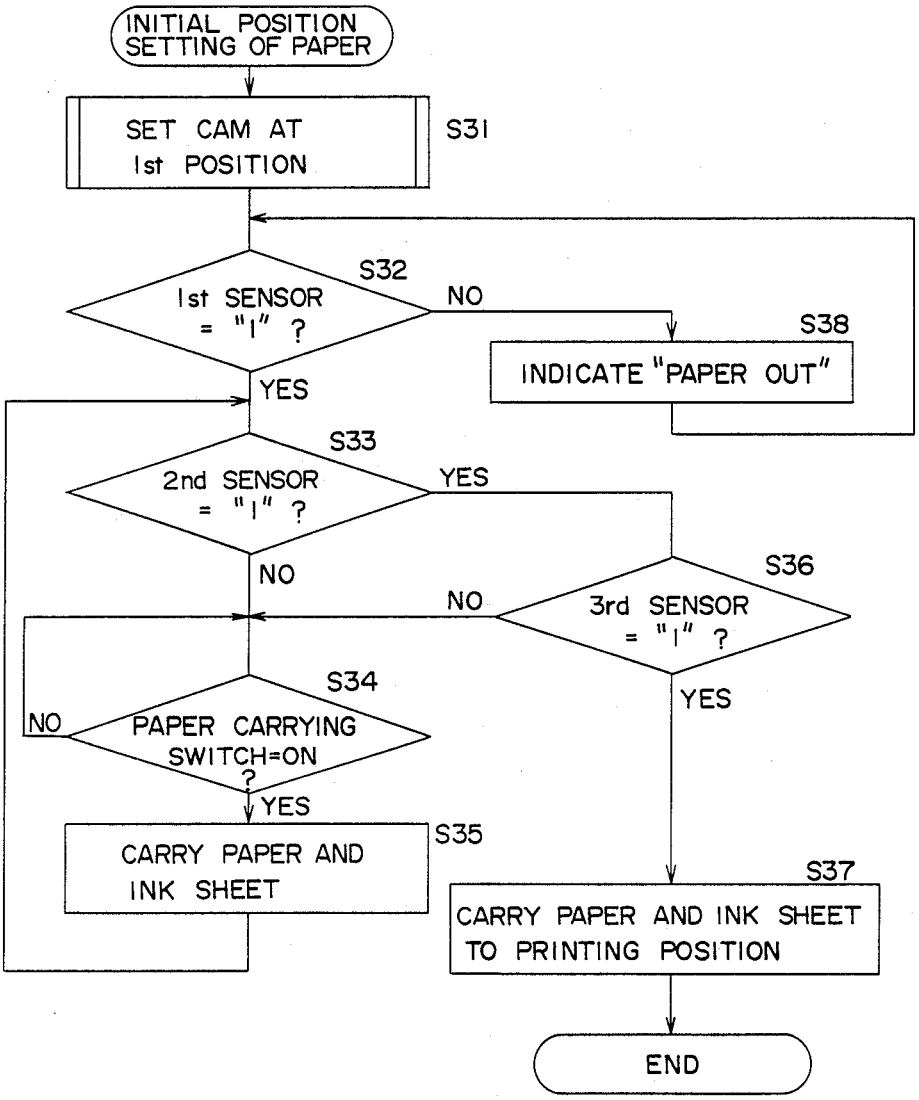
FIG. 14 is a flow chart showing the control sequence for initialization of position of the recording paper by means of the control unit.

Control for initial position setting of the recording paper 13 by means of the control unit 90 will be described with reference to a flow chart in FIG. 14.

When the eccentric cam 68 is not being set in the first position, the control unit 90 sets the eccentric cam 68 in the first position depending on the abovesaid control (step S31) to keep the thermal transfer head 5 pressed to the platen 6.

When the recording paper 13 is drawn from the recording paper roll 12 by the operator and the foremost end thereof is inserted into the printer through the insertion opening 15*a* and positioned on the contact part between the platen 6 as the first paper carrier roller and the first pressing roller 17, the first sensor 100 detects the recording paper 13 and outputs a predetermined signal "1" to the control unit 90 (step S32). In the case where the first sensor 100 detects absence of the recording paper 13, an indication as "paper out" is displayed on the indication part 123 of the casing 120 (step S38).

When a recording paper carrier switch placed on the key board 92 is turned on while only the first sensor detects the recording paper 13 (step S34), the platen 6 and the paper carrier roller 18 are driven clockwise respectively. Thus, the recording paper 13 is carried from the contact part between the platen 6 and the first pressing roller 17 to another contact part between the platen 6 and the thermal transfer head 5 and further to still another contact part between the paper carrier roller 18 and the second pressing roller 19 (step S35) until the second sensor 101 detects the recording paper 13 and outputs a signals "1" (step S33).

In this way, the recording paper 13 is further carried after the foremost end thereof is detected by the second sensor 101 (step S34). When the detection signal "1" is outputted to the control unit 90 (step S36) with detection of a printing start position mark impressed on the recording paper 13 by the third sensor 102, the control unit 90 further carries the recording paper 13 by a predetermined length (step S37) so as to bring the actual printing start position on the recording paper into adjustment with a printing position of the thermal transfer head 5.

Since initial position setting for the recording paper 13 as above is performed in a state that the thermal transfer head 5 is pressed to the platen 6, that is, the eccentric cam 68 is set in the first position, so the ink sheet 2 is also carried in the forward direction by the same length as that of the recording paper 13. Therefore, if the above state continues as it is, a length of the ink sheet 2 carried during initial position setting of the recording paper 13 is useless and, in view of this drawback, rewinding of the ink sheet 2 in the thermal transfer printer of this invention is so designed as to be performed at the time of position adjustment of the ink sheet 2.

Figure 15:
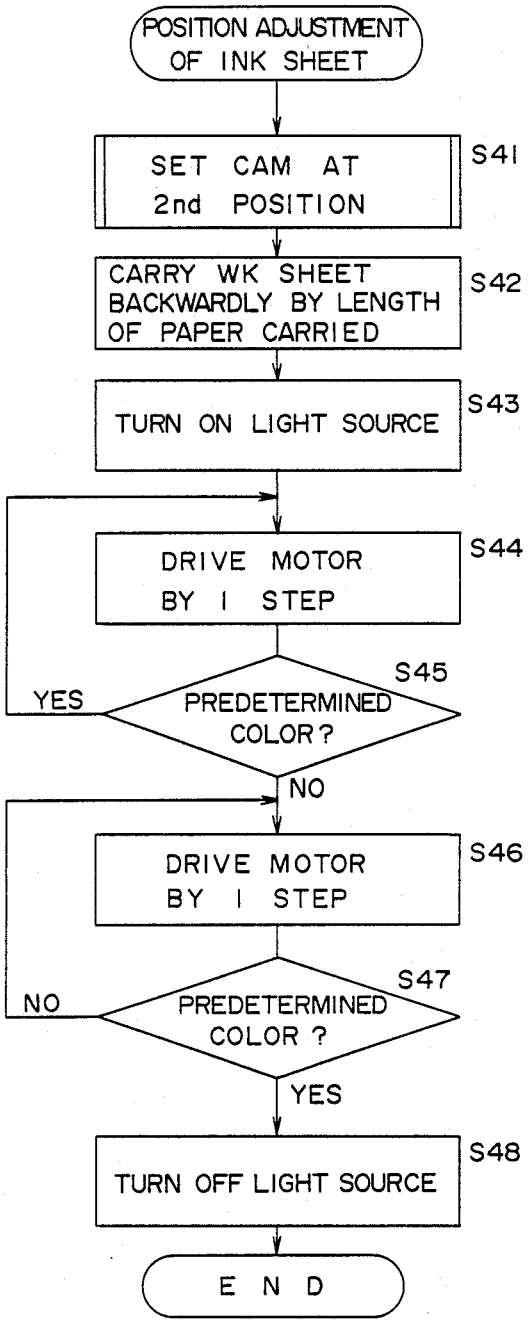
FIG. 15 is a flow chart showing the control sequence for adjustment of position of the ink sheet by means of the control unit.

FIG. 15 is a flow chart showing a sequence of the control unit 90 in position adjustment of the ink sheet 2.

Position adjustment of the ink sheet 2 is to bring the foremost end of each section of ink sheet 2 having four colors as yellow:Y, magenta:M, cyan:C, and black:B face sequentially into exact adjustment with respective printing positions (positions for line of heating elements of the thermal transfer head 5). Position adjustment of the ink sheet 2 is carried out in an initial state immediately after the power is switched on and prior to printing with a section in one color following the finish of printing with the preceding color.

Control of position adjustment of the ink sheet 2 is performed by the control unit 90 on the basis of a detection signal obtained from the color sensor 111 which detects light rays passing through the ink sheet 2 emitted from the light source 110 disposed to face the sensor 111 with the carrying passage for the ink sheet 2 interposed therebetween. As a color sensor for the use as above, for example, an amorphous integrated full color sensor as disclosed in the Japanese Patent, Laid-Open No. 58-125865 (1983) is suitable. The color sensor disclosed therein is so composed as to provide three bits of signals in response to the color of light received thereby.

For position adjustment of the ink sheet 2, the control unit, first, performs controls for setting the eccentric cam 68 in the second position to release the thermal transfer head 5 from the platen 6 (step S41). Since the ink sheet 2 is carried in the forward direction by a length equal to that of the recording paper carried at the time of initial position setting of the recording paper 13, the control unit 90 performs control to drive the driving motor 30 in the opposite direction and carries the ink sheet 2 in the opposite direction by a length as described above (step S42).

The control unit 90 then turns on the light source 110 (step S43). At this time, if the required color (yellow at the time of initial setting) is detected, the control unit 90 drives the driving motor 30 to carry the ink sheet 2 step by step in the forward direction until the color is not detected (steps S44 and S45). Afterward, the control unit 90 drives the driving motor 30 to carry the ink sheet 2 step by step in the forward direction until the required color is again detected (steps S46 and S47). When the required color is detected at step S45 as above, the detected position is not proved to be the foremost end position of a section having the required color, however, since the other color is detected afterward and the other section having the other color is carried in the forward direction until the required color is again detected, the foremost end position of the section having the required color is substantially detected.

Subsequently, the control unit 90 turns off the light source 110 (step S48) and completes the process of position adjustment of the ink sheet 2.

When the recording paper 13 and the ink sheet 2 are separately subjected to initial position adjustment as above, the control unit 90 performs control to set the eccentric cam 68 in the first position so that the thermal transfer head 5 presses to the platen 6, and carries the recording paper 13 and the ink sheet 2 while synchronizing carrying speeds for the ink sheet 2 and recording paper 13. In such a state as above, control over heat generation at a line of heating elements of the thermal transfer head 5 provides thermal transfer printing with one color, for example, yellow.

Figure 16:
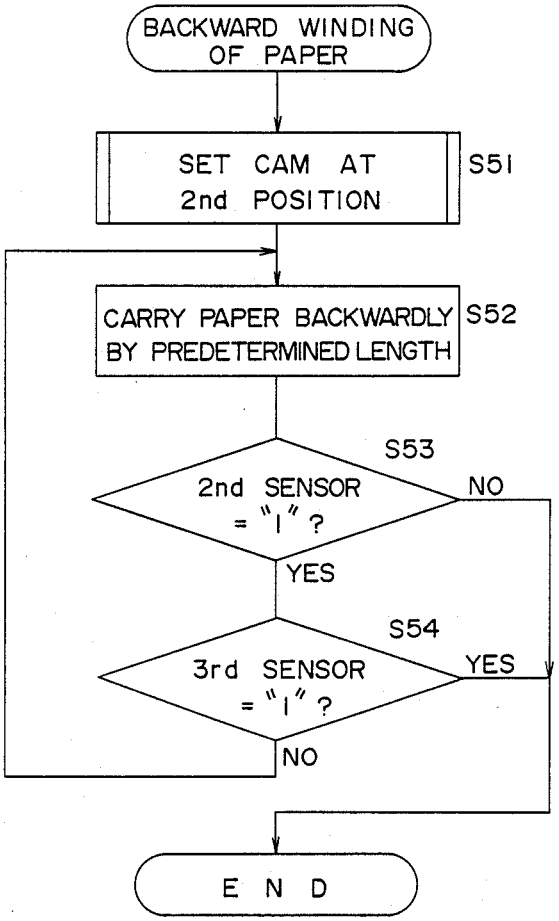
FIG. 16 is a flow chart showing the control sequence for backward carrying of the recording paper by means of the control unit after completing the printing with one color.

Subsequently to the completion of thermal transfer printing in yellow ink as a first-color ink, the recording paper 13 is rewound. FIG. 16 is a flow chart showing a sequence of control over rewinding of the recording paper 13 by means of the control unit 90.

The control unit 90 operates to release the thermal transfer head 5 from the platen 6 (to set the eccentric cam 68 in the second position) (step S51). The control unit 90 then rewinds the recording paper 13 step by step, that is, carries the recording paper 13 in the reverse direction (step S52, S53, and S54) until the foremost end of the recording paper 13 is detected by the second sensor 101, that is, the foremost end of the reocrding paper 13 is carried to the side of the platen 6 beyond the detecting position for the second sensor 101, or the printing start position mark on the recording paper 13 is detected by the third sensor 102. Usually, the printing start position mark on the recording paper 13 is first detected by the third sensor 102 through the abovesaid process and, therefore, initial position setting of the recording paper 13 is possible after the abovesaid detection.

In the result that the printing start position mark cannot be detected by the third sensor 102 for some reasons during the carrying of the recording paper 13 in the reverse direction, detection of the foremost end of the recording paper 13 by the second sensor 101 prevents the foremost end of the recording paper 13 from being carried in the reverse direction beyond the contact part between the paper carrier roller 18 and the second pressing roller 19. Accordingly, excessive rewinding of the recording paper 13 to slip off the contact part between the paper carrier roller 18 and the second pressing roller 19 is prevented. Even in such a case as excessive rewinding of the recording paper 13, intial position setting as described above can be performed accurately.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds thereof are therefore intended to be embraced by the claims.

What is claim is:

1. A thermal transfer printer including a thermal transfer head and a platen, said head being shiftable between a contact position with said platen and a non-contact position comprising;

an eccentric cam rotationally controlled so as to be positionable between a first and second position;

a cam follower being mechanically connected to said thermal transfer head and biased against said eccentric cam wherein upon said eccentric cam rotating into its said first position said thermal transfer head is biased into its said contact position with said platen, upon said eccentric cam rotating into its said second position, said thermal transfer head is biased into its said non-contact position;

a motor for rotationally driving said eccentric cam;

a sensor for detecting that said eccentric cam is in a predetermined zone, said predetermined zone of said eccentric cam being between the said first and second positions of said cam;

means for controlling the rotation of said motor to rotate said eccentric cam in a direction toward said second position upon said sensor detecting that said eccentric cam is in said predetermined zone, and after the rotation, said control means causing said motor to rotate said eccentric cam toward said second position a first predetermined amount ($\theta$) upon said sensor detecting that said eccentric cam is out of predetermined zone.

2. A thermal transfer printer including a thermal transfer head and a platen, said head being shiftable between a contact position with said platen and a non-contact position comprising;

an eccentric cam rotationally controlled so as to be positionable between a first and second position;

a cam follower being mechanically connected to said thermal transfer head and biased against said eccentric cam wherein upon said eccentric cam rotating into its said first position said thermal transfer head is biased into its said contact position with said platen, upon said eccentric cam rotating into its said second position, said thermal transfer head is biased into its said non-contact position;

a motor for rotationally driving said eccentric cam;

a sensor for detecting that said eccentric cam is in a predetermined zone, said predetermined zone of said eccentric cam being between the said first and second position of said cam;

said control means causing said motor to rotate said eccentric cam in a direction toward said second position by a second predetermined amount ($\theta$) upon said sensor detecting that said eccentric is out of said predetermined zone;

after rotation toward said second position by said second predetermined amount ($\theta$), said control means causing said motor to rotate said eccentric cam further toward said second position upon said sensor detecting that said cam is in said predetermined zone, and after said rotation, said control means causing said motor to rotate said eccentric cam toward said second position a first predetermined amount ($\theta$) upon said sensor detecting that said eccentric cam is out of said predetermined zone; and after rotation toward said second position by said second predetermined amount ($\theta$), said control means causing said motor to rotate said eccentric cam in a direction towards said first position upon said sensor detecting that said eccentric cam is out of said predetermined zone, until said sensor detects that said eccentric cam is in said predetermined zone, and causing said motor to rotate toward said second position, and after said rotation, said control means causing said motor to rotate said eccentric cam toward said second position said first predetermined amount ($\theta$) upon said sensor detecting that said eccentric cam is out of said predetermined zone;

3. A thermal transfer printer including a thermal transfer head and a platen, said head being shiftable between a contact position with said platen and a non-contact position comprising;

an eccentric cam rotationally controlled so as to be positionable between a first and second position;

a cam follower being mechanically connected to said thermal transfer head and biased against said eccentric cam wherein upon said eccentric cam rotating into its said first position said thermal transfer head is biased into its said contact position with said platen, upon said eccentric cam rotating into its said second position, said thermal transfer head is biased into its said non-contact position;

a motor for rotationally driving said eccentric cam;

a sensor for detecting that said eccentric cam is in a predetermined zone, said predetermined zone of said eccentric cam being between the said first and second position of said cam;

means for controlling the rotation of said motor to rotate said eccentric cam in a direction toward said second position upon said sensor detecting that said eccentric cam is in said predetermined zone, and after the rotation, said control means causing said motor to rotate said eccentric cam toward said second position a first predetermined amount ($\theta$) upon said sensor detecting that said eccentric cam is out of said predetermined zone;

said control means causing said motor to rotate said eccentric cam toward said second position by a second predetermined amount ($\theta$) upon said sensor detecting that said eccentric cam is out of said predetermined zone;

after rotation toward said second position by said second predetermined amount ($\theta$), said control means causing said motor to rotate said eccentric cam further toward said second position upon said sensor detecting that said cam is in said predetermined zone, and after said rotation, said control means causing said motor to rotate said eccentric cam toward said second position said first predetermined amount ($\theta$) upon said sensor detecting that said eccentric cam is out said predetermined zone; and after rotation toward said second position by said second predetermined amount ($\theta$), said control means causing said motor to rotate said eccentric cam in a direction toward said first position upon said sensor detecting that said eccentic cam is out of said predetermined zone, until said sensor detects that said eccentric cam is in said predetermined zone, and causing said motor to rotate said eccentric cam toward said second position, and after said rotation, said control means causing said motor to rotate said eccentric cam toward said second position said first predetermined amount ($\theta$) upon said sensor detecting that said eccentric cam is out of said predetermined zone.

4. A method for initializing a thermal transfer printer having a thermal transfer head and a platen to position said head in a non-contact position with said platen upon initiation of power to said printer, said method comprising:

(a) providing an eccentric cam rotationally controlled so as to be positionable between a first and second position;

(b) providing a cam follower being mechanically connected to said thermal transfer head and biased against said eccentric cam whereby upon said eccentric cam rotating into its said first position said thermal transfer head is biased into its said contact position with said platen, upon said eccentric cam rotating into its said second position, said thermal transfer head is biased into its said non-cantact position;

(c) providing a motor for rotationally driving said eccentric cam;

(d) sensing that said eccentric cam is in a predetermined zone, said predetermined zone of said eccentric being between said first and second positions of said cam;

(e) rotating said eccentric cam in a direction toward said second position upon sensor that said eccentric cam is in said predetermined zone, and rotating said eccentric cam toward said second position a first predetermined amount ($\theta$) upon sensing said eccentric cam is out of said predetermined zone.

5. A method for initializing a thermal transfer printer having a thermal transfer head and a platen to position said head in a non-contact position with said platen upon initiation of power to said printer, said method comprising:

(a) providing an eccentric cam rotationally controlled so as to be positionable between a first and second position;

(b) providing a cam follower being mechanically connected to said thermal transfer head and biased against said eccentric cam whereby upon said eccentric cam rotating into its said first position said thermal transfer head is biased into its said contact position with said platen, upon said eccentric cam rotating into its said second position, said thermal transfer head is biased into its said non-contact position;

(c) providing a motor for rotationally driving said eccentric cam;

(d) rotating said eccentric cam in a direction towards said second position by a second predetermined amount ($\theta$) upon sensing said eccentric cam is out of a predetermined zone, said predetermined zone of said eccentric cam being between said first and second position of said cam;

(e) rotating said eccentric cam in a direction toward said second position upon sensing that said eccentric cam is in said predetermined zone, and rotating said eccentric cam toward said second position a first predetermined amount ($\theta$) upon sensing said eccentric cam is out of said predetermined zone.

6. A method for initializing a thermal transfer printer having a thermal transfer head and a platen to position said heat in a non-contact position with said platen upon initiation of power to said printer, said method comprising:

(a) providing an eccentric cam rotationally controlled so as to be positionable between a first and second position;

(b) providing a cam follower being mechanically connected to said thermal transfer head and biased against said eccentric cam whereby upon said eccentric cam rotating into its said first position said thermal transfer head is biased into its said contact position with said platen, upon said eccentric cam rotating into its said second position, said thermal transfer head is biased into its said non-contact position;

(c) providing a motor for rotationally driving said eccentric cam;

(d) rotating said eccentric cam in a direction towards said second position by a second predetermined amount ($\theta$) upon sensing said eccentric cam is out of a predetermined zone, said predetermined zone of said eccentric cam being between the first said and second positions of said eccentric cam;

(e) sensing that said eccentric cam is out of said predetermined zone after rotation of said eccentric cam by a second predetermined amount and rotating said eccentric cam in a direction toward said first position until said eccentric cam is sensed in said predetermined zone;

(f) rotating said eccentric cam in a direction toward said second position upon sensing that said eccentric cam is in said predetermined zone, and rotating said eccentric cam toward said second position a first predetermined amount ($\theta$) upon sensing said eccentric cam is out of said predetermined zone.

* * * * *